US008640375B2

(12) United States Patent
Ketchum

(10) Patent No.: US 8,640,375 B2
(45) Date of Patent: Feb. 4, 2014

(54) 1911 HANDGUN DISASSEMBLY TOOL AND METHOD OF MAKING SAME

(76) Inventor: Richard Ketchum, Bremond, TX (US)

( * ) Notice: Subject to any disclaimer, the term of this patent is extended or adjusted under 35 U.S.C. 154(b) by 451 days.

(21) Appl. No.: 12/798,893

(22) Filed: Apr. 13, 2010

(65) Prior Publication Data

US 2010/0269394 A1 Oct. 28, 2010

Related U.S. Application Data

(60) Provisional application No. 61/169,438, filed on Apr. 15, 2009.

(51) Int. Cl.
*F41C 27/00* (2006.01)

(52) U.S. Cl.
USPC ..... 42/108; 42/90

(58) Field of Classification Search
USPC ..... 42/108, 90, 106
See application file for complete search history.

(56) References Cited

U.S. PATENT DOCUMENTS

| | | | | |
|---|---|---|---|---|
| 4,901,411 | A * | 2/1990 | Chestnut et al. | 42/108 |
| 6,430,862 | B1 * | 8/2002 | Berlin | 42/90 |
| 7,240,450 | B2 * | 7/2007 | Shober | 42/108 |
| 7,401,432 | B2 * | 7/2008 | Perry | 42/108 |

* cited by examiner

*Primary Examiner* — J. Woodrow Eldred
(74) *Attorney, Agent, or Firm* — Kenneth D. Baugh

(57) ABSTRACT

A disassembly tool 60 is provided for a handgun 10. The disassembly tool 60 includes spaced aligned upstanding side wall members 74 having a longitudinally extending slot 64 formed therebetween. A diagonally descending wall member 76 is formed on each one of the upstanding side wall members 74 to facilitate positioning of the slot 64 on a guide rod 20 so that a spring assembly 18 is compressed to allow disassembly of the handgun 10. The method of making the tool 60 includes machining a bar 62 to a predetermined length. A longitudinally extending slot 64 is then formed in the bar 62 creating upstanding side wall members 74. The upstanding side wall members 74 are then machined to a predetermined angle so that diagonally descending wall members 76 are formed.

7 Claims, 3 Drawing Sheets

1911 HANDGUN DISASSEMBLY TOOL AND METHOD OF MAKING SAME

TECHNICAL FIELD

This application claims priority of Provisional Application Ser. No. 61/169,438 filed on Apr. 15, 2009.

This invention relates to a handgun and more particularly to a handgun disassembly tool to be used on the 1911 bull barrel handgun and a method of making same. Handgun safety is very important and is an ongoing concern in today's society. Routine maintenance of the handgun is a considerable factor in contributing to handgun safety. Accordingly, the periodic cleaning of the handgun is an absolute necessity. To accomplish this the handgun must be disassembled. Of course one must have the proper tools to disassemble the handgun. Routine maintenance of handguns such as the 1911 bull barrel pistol can be somewhat cumbersome and difficult because the tools available to disassemble the handgun are not the most desirable. In order to disassemble the handgun the slide and barrel assembly must be removed from the frame of the gun. This is accomplished by holding the slide in a partially retracted predetermined position while a barrel pin in the frame is removed from the handgun. Otherwise the barrel pin cannot be accessed and the slide and barrel assembly cannot be removed. An apparatus to readily and easily facilitate this process is desirable.

BACKGROUND ART

Attempts have been made to provide devices to facilitate disassembly and assembly of a handgun. One such device is illustrated in U.S. Pat. No. 7,140,141B2. The handgun of this invention includes a frame and a movable slide mounted in the frame. The slide defines an ejection port and lateral walls that extend longitudinally from a rear face of the slide adjacent a front face through which an opening is formed to permit egress of a round of ammunition. The handgun further includes a firing pin mechanism and an access port formed in the lateral walls of the slide. Disassembly of the gun is accomplished with a probe which is provided to be inserted in the access port to manipulate the firing pin mechanism and allow removal of the slide from the frame. Although this invention provides a tool to accomplish the desired result because of the size of the tool relative to the access port the disassembly process can still be somewhat cumbersome and require significant manipulation.

Another apparatus is disclosed in U.S. Pat. No. 7,240,450B2. In this arrangement a device is provided with an indentation for receiving a front face of the handgun. The indentation is at least partially surrounded by a raised ridge adopted to prevent the slide from entering the indentation. Placing the barrel in the indentation forces the slide backwards from the front face. The elevation difference between the depth of the indentation and the ridge is selected to expose the barrel pin of the handgun through an ejector side hole. Once this is accomplished a pin removal tool may be inserted into the ejector side hole and the pin pushed out thus allowing disassembly of the handgun. This tool can also be somewhat difficult to use because of its size. Additionally, because of the size of the pin removal tool and hole this process can also be somewhat cumbersome and require significant manipulation.

DISCLOSURE OF THE INVENTION

A disassembly tool is provided for use with a handgun having a guide rod and spring assembly securing a slide to a frame of the handgun. The disassembly tool includes a base member having an opening formed therein at one end thereof. A pair of spaced aligned upstanding side wall members are formed on the base member so that a longitudinally extending slot is formed therebetween adjacent the base member. The disassembly tool is also provided with a pair of diagonally descending wall members. Each one of the diagonally descending wall members is formed on a corresponding one of the upstanding side wall members at an end adjacent the opening in the base member. The diagonally descending wall members are provided to facilitate the proper positioning of the longitudinally extending slot on the guide rod so that the guide rod is held in the longitudinally extending slot while the spring assembly is compressed to allow release of the slide and disassembly of the handgun when the tool engages the spring assembly.

The method of making the tool of this invention includes the steps of machining a predetermined size round bar having a predetermined diameter to a predetermined length. Once this is done an opening is formed in one end of the bar at a base portion thereof and a longitudinally extending slot having a predetermined radius and depth is machined through the entire length of the bar thereby forming upstanding side wall members on each side of the slot having the same diameter as the bar. The upstanding side wall members are then machined at an end thereof adjacent the opening in the base portion of the bar to a predetermined angle across the opening side of the longitudinally extending slot for a predetermined distance from the end thereof so that a diagonally descending wall member is formed on each one of the upstanding side wall members.

BRIEF DESCRIPTION OF THE DRAWING

The details of the invention will be described in connection with the accompanying drawing in which.

BEST MODE FOR CARRYING OUT THE INVENTION

Figure 1:
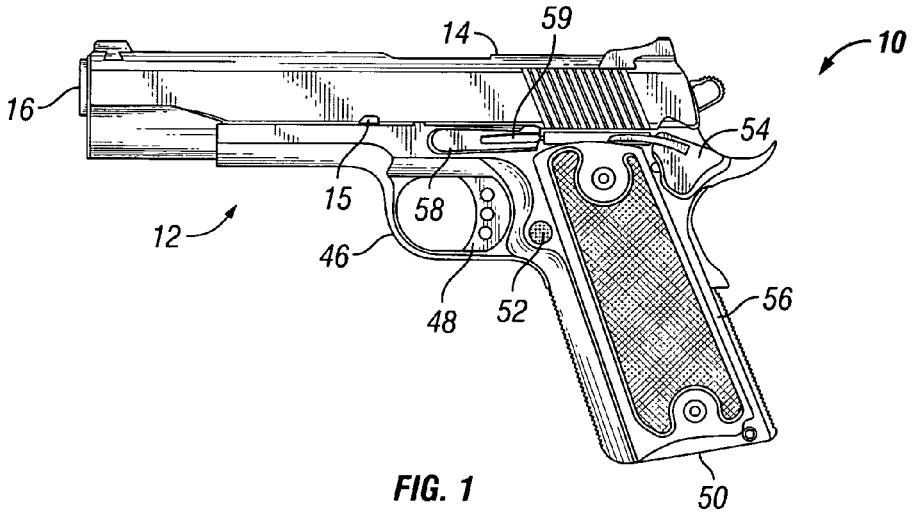
FIG. 1 is a side view of an assembled 1911 handgun in accordance with the principles of the invention.
Figure 2:
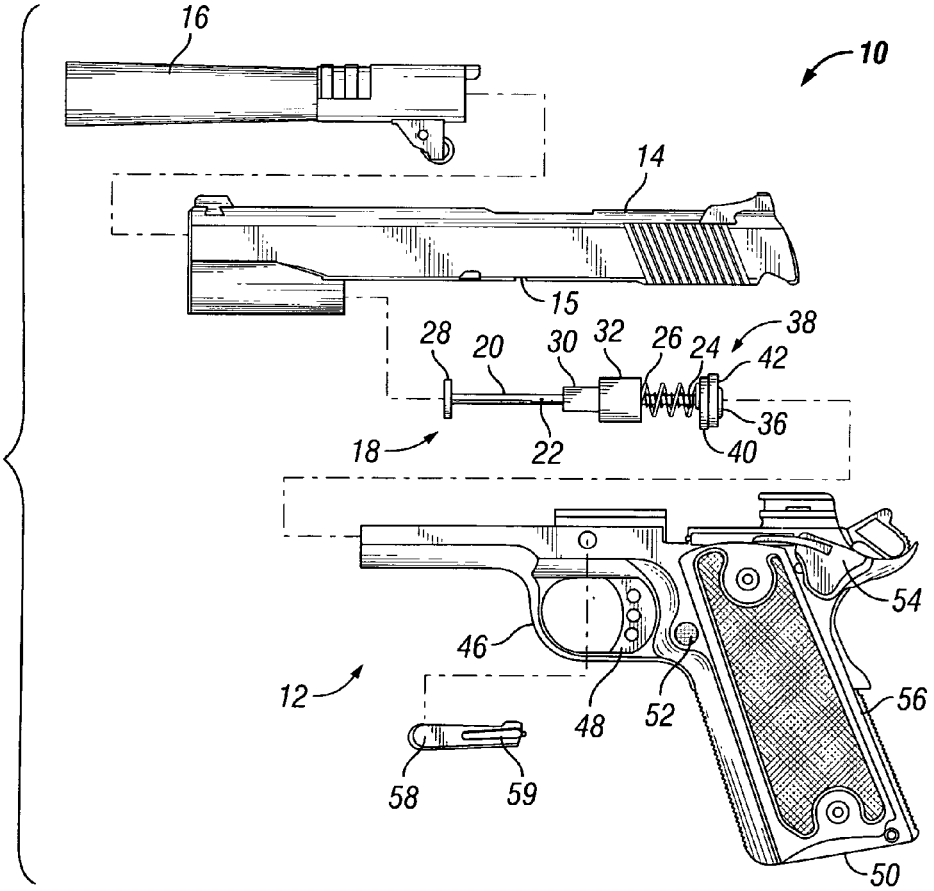
FIG. 2 is a side perspective exposed view of a 1911 handgun in accordance with the principles of the invention.

Referring to FIGS. 1 and 2 there is shown a 1911 bull barrel handgun, generally designated, by the numeral, 10 including a frame, generally designated, by the numeral 12. The handgun 10 also includes a slide 14 having a slide disassembly notch 15, and barrel 16 which are located on an upper portion of the frame 12 in a well known manner. An internal return spring assembly generally designated, by the numeral 18 (FIG. 2) is provided with a guide rod 20 having an aperture 22 formed therein (FIG. 2). The return spring assembly is also provided with a primary spring 24 and secondary spring 26. The internal spring assembly 18 also includes primary and secondary spring retainers 30 and 32 for retaining the springs 24 and 26, respectively, in predetermined positions on the guide rod 20. Back ends of the springs 24 and 26 are aligned adjacent an end plate of the guide rod 20, generally designated, by the numeral 38. The end plate 38, for example, may include a shock buffer 40, and a recoil guide rod head 42 affixed to an end 36 of the guide rod. This allows the springs 24 and 26 to be held in an extended position when the slide 14 is at a rest position (FIG. 1).

As is standard, the frame 12 of the handgun 10 is also provided with a trigger guard 46, trigger 48, a magazine 50 with a release button 52, a safety 54 and a gripping house 56. A slide lock 58 having a back portion 59 is also provided which will facilitate the release of the component parts of the handgun so the gun can be disassembled (FIG. 2) when the springs 24 and 26 are compressed a predetermined distance.

Figure 3A:
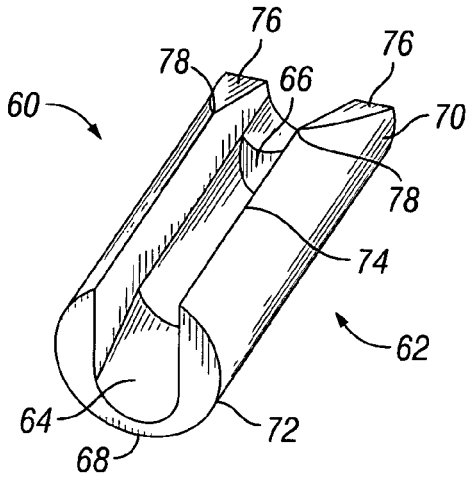
FIG. 3A is a rear perspective view of disassembly tool in accordance with the principles of the invention.
Figure 3B:
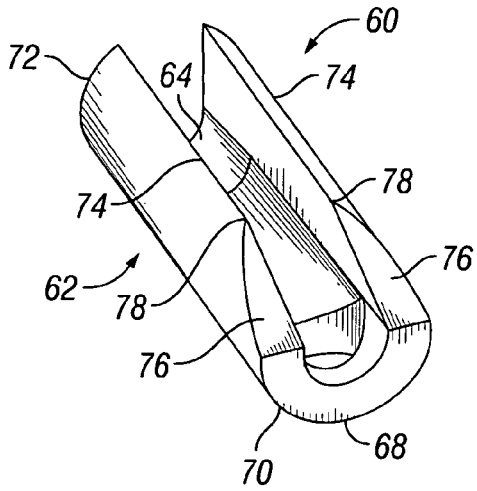
FIG. 3B is a front perspective view of a disassembly tool in accordance with the principles of the invention.

As illustrated in FIG. 3 a disassembly tool, generally designated, by the numeral 60 is provided to facilitate compression of the springs 24 and 26, so that the handgun 10 can be disassembled. The tool 60 is formed of a round bar, generally designated, by the numeral, 62 (only partially shown) having for example, a three eighth inch diameter. The material may be, for example, brass, aluminum, plastic, steel or any other such material. The bar 62 may be, for example one half (½) to two (2) inches in length and has a longitudinally extending slot 64 and an opening 66 formed in a bottom portion or base 68 thereof. The radius of the slot 64, may be, for example, ninety-four thousandths (0.094) of an inch and the slot extends from end 70 of the bar 62 to end 72. The depth of the longitudinally extending slot may be two hundred eighty one thousandths (0.281) of an inch deep.

The bar 62 is also provided at the open end 70 thereof that is, the end including the opening 66, with an upper portion thereof having a predetermined angle formed therein, for example, an angle of thirty (30) degrees, aligned to extend across the opening end side of the longitudinally extending slot 68 a distance of one hundred fifty-seven thousandths (0.157) of an inch back from the end of the bar. Once the bar has been formed as herein described, the result is a tool 60 having a base member 68 having an opening 66 formed in one end 70 thereof.

Additionally, the tool 60 includes a pair of spaced aligned upstanding side wall members 74 formed on the base member 68 so that the longitudinally extending slot 64 is formed therebetween adjacent the base member. The tool 60 also includes a diagonally descending upper wall member 76 which diagonally descends from an intermediate portion 78 of each upstanding side wall member to the end 70 thereof. The diagonally descending wall members 76 facilitate the proper positioning of the longitudinally extending slot 64 on the guide rod 20 so that the guide rod can be held in the longitudinally extending slot and so that the spring assembly 18 is compressed to allow release of spring pressure on the slide 14 when the tool 60 engages the spring assembly.

The method of making the tool 60 includes a first step of machining a predetermined size brass round bar 62 having a predetermined diameter to a predetermined length. A longitudinally extending slot 64 having a predetermined radius and depth are then formed in a lower base portion 68 of the bar 62 along with an opening 66 in a base 68 of the bar. The slot 64 is formed to extend through the entire length of the bar 62 from one end 70 thereof to another end 72 thereof thereby forming upstanding side wall members 74 on each side of the longitudinally extending slot having the same diameter as the bar 62. Once this is accomplished the upstanding side wall members 74 of the bar 62 are then machined at end 70 thereof to a predetermined angle across an opening side of the longitudinally extending slot for a predetermined distance from the end 70 thereof so that a diagonally descending wall member 76 is formed on each one of the upstanding side wall members.

Figure 4:
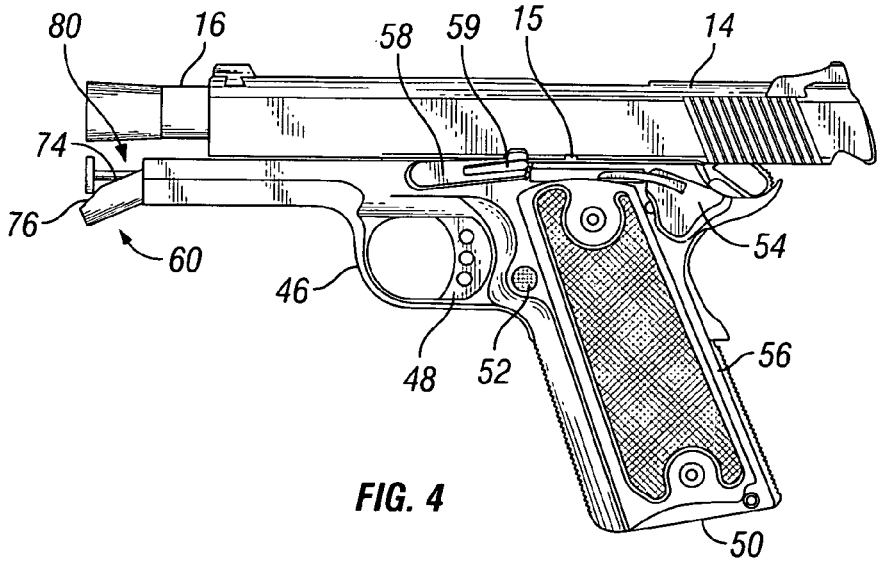
FIG. 4 is a side view of a 1911 handgun with the disassembly tool being attached thereto when being used in accordance with the principles of the invention.
Figure 5:
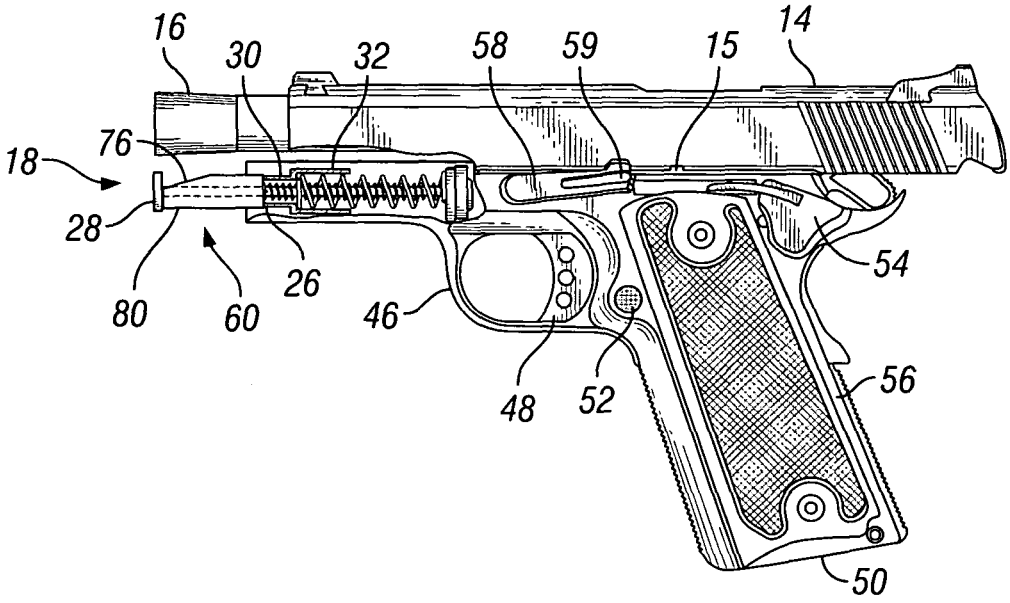
FIG. 5 is a partial cross-sectional side view of a 1911 handgun being used with the disassembly tool attached thereto in a first position in accordance with the principles of the invention.
Figure 6:
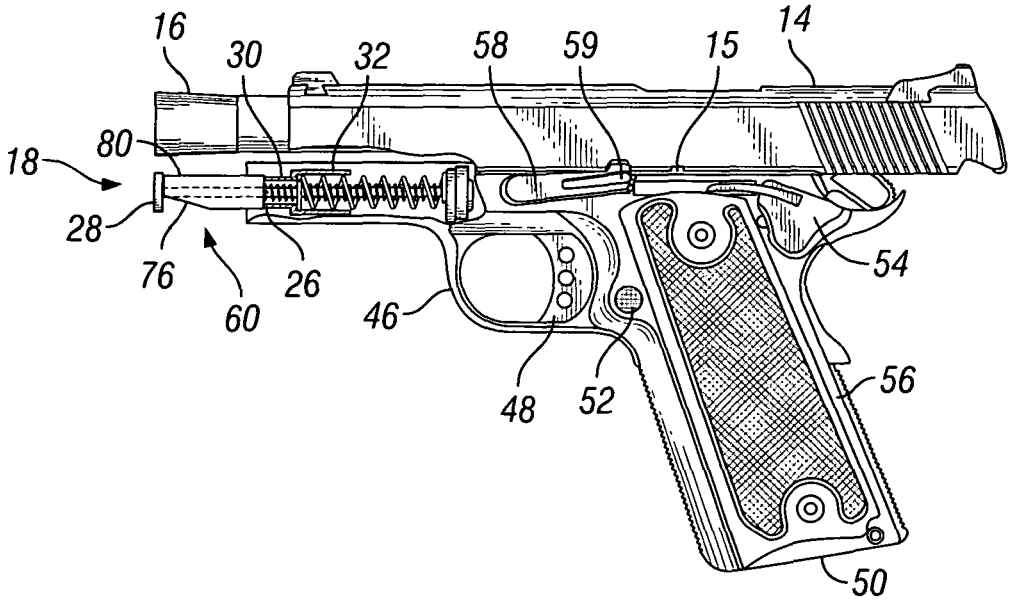
FIG. 6 is a partial cross-sectional side view of a 1911 handgun being used with the disassembly tool attached thereto in a second position in accordance with the principles of the invention.

As illustrated in FIGS. 4, 5 and 6 when in use the tool 60 is slide in place, with the slot 64 up and the angled open end 70 of the tool facing a muzzle end of the gun 10, into a space 80 between the end 28 of the guide rod 20 and the spring retainer 30 using slight pressure to place the tool. While the angled open end 70 of the tool 60 is being pressed in place this compresses the springs 24 and 26 of the spring assembly 18 to a position where the slide disassembly notch 15 is aligned with the back portion 59 of the slide lock. Once the springs 24 and 26 are compressed to this point the tool 60 is rotated (FIG. 6) so the slot is faced downwardly to prevent the tool from falling. When the spring 24 is compressed the slide lock 58 can be removed so the slide 14 can be released and the handgun 10 disassembled as shown in FIG. 2. The component parts of the handgun can then be cleaned.

After the cleaning has been completed the handgun 10 can be reassembled in the normal manner and the slide 14 locked backed in place. Once this is done a slight pressure is applied to remove the tool 60 by pressing the angled open end 70 of the tool down and pulling it out of the space 80.

The invention has been shown and described in what is considered to be the most practical and preferred embodiment. However, it should be recognized that changes may be made by those skilled in the art without departing from the spirit and scope of the invention.

What is claimed:

1. An improved handgun disassembly tool for use with a handgun comprising:

a base member having an opening formed therein at one end thereof;

a pair of spaced aligned upstanding side wall members formed on the base member so that a longitudinally extending slot is formed therebetween throughout the entire length of the base member; and a pair of diagonally descending wall members, one of the pair of diagonally descending wall members being formed on a corresponding one of the upstanding side wall members at an end thereof adjacent the opening in the base member for facilitating the proper positioning of the longitudinally extending slot on a guide rod of the handgun so that the guide rod is held in the longitudinally extending slot and a spring assembly of the handgun compressed to allow release of spring pressure on a slide of the handgun and disassembly of the gun when the tool engages the spring assembly.

2. An improved handgun disassembly tool as defined in claim 1 wherein the base member is provided having a predetermined length and diameter.

3. An improved handgun disassembly tool as defined in claim 2 wherein the upstanding side wall members have a predetermined length and diameter equal that of the base member.

4. An improved handgun disassembly tool as defined in claim 3 wherein the longitudinally extending slot formed between the upstanding side wall members on the base member has a predetermined radius.

5. An improved handgun disassembly tool as defined in claim 4 wherein the longitudinally extending slot is formed between the upstanding side wall members at a predetermined depth therebetween.

6. An improved handgun disassembly tool as defined in claim 5 wherein the longitudinally extending slot has a depth of two hundredth eighty one thousandths of an inch and a radius of ninety-four thousandths of an inch.

7. An improved handgun disassembly tool as defined in claim 6 wherein the base member and upstanding side wall members have a diameter of three eights of an inch.

* * * * *